US008109842B2

(12) United States Patent
Matsunaga

(10) Patent No.: US 8,109,842 B2
(45) **Date of Patent: *Feb. 7, 2012**

(54) HOLLOW GOLF CLUB HEAD

(75) Inventor: Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 75 days.

This patent is subject to a terminal disclaimer.

(21) Appl. No.: 11/320,802

(22) Filed: Dec. 30, 2005

(65) Prior Publication Data

US 2007/0049409 A1 Mar. 1, 2007

(30) Foreign Application Priority Data

Aug. 23, 2005 (JP) ..... 2005-241747

(51) Int. Cl.
*A63B 53/00* (2006.01)

(52) U.S. Cl. ..... 473/345; 473/349

(58) Field of Classification Search ..... 473/345; *A63B 53/04*

See application file for complete search history.

(56) References Cited

U.S. PATENT DOCUMENTS

| | | | | |
|---|---|---|---|---|
| 4,139,196 | A | 2/1979 | Riley | |
| 5,180,166 | A | 1/1993 | Schmidt et al. | |
| 5,205,560 | A | 4/1993 | Hoshi et al. | |
| 5,255,913 | A | 10/1993 | Tsuchida | |
| 5,316,298 | A | 5/1994 | Hutin et al. | |
| 5,346,217 | A | 9/1994 | Tsuchiya et al. | |
| 5,351,958 | A | 10/1994 | Helmstetter | |
| 5,411,255 | A | 5/1995 | Kurashima et al. | |
| 5,511,786 | A | 4/1996 | Antonious | |
| 5,573,467 | A * | 11/1996 | Chou et al. | 473/289 |
| 5,697,855 | A | 12/1997 | Aizawa | |
| 5,755,627 | A | 5/1998 | Yamazaki et al. | |
| 5,916,038 | A | 6/1999 | Uchiyama et al. | |
| 5,954,594 | A | 9/1999 | Uchiyama et al. | |
| 6,162,133 | A | 12/2000 | Peterson | |
| 6,348,013 | B1 | 2/2002 | Kosmatka | |
| 6,494,790 | B1 * | 12/2002 | Toyota et al. | 473/345 |
| 6,572,491 | B2 * | 6/2003 | Hasebe et al. | 473/349 |
| 6,719,645 | B2 | 4/2004 | Kouno | |

(Continued)

FOREIGN PATENT DOCUMENTS

GB 2 249 031 A 4/1992

(Continued)

OTHER PUBLICATIONS

Jeff Jackson, "The Modern Guide to Golf Clubmaking", Dynamic Golf Products Inc., p. 237, 1994.*

*Primary Examiner* — Gene Kim
*Assistant Examiner* — Michael Dennis
(74) *Attorney, Agent, or Firm* — Sughrue Mion, PLLC

(57) ABSTRACT

This invention provides an improved hollow golf club head having a sole portion and a crown portion, wherein the golf club head is configured so as to increase the launch angle of a ball so that the traveling distance of a golf shot can be increased. In particular, the sole portion and the crown portion of the hollow golf club head are configured such that the ratio of a rigidity of the sole portion to a rigidity of the crown portion is 1:0.1 to 0.8 and, as a result of such a configuration, the launch angle of a hit ball is increased.

9 Claims, 8 Drawing Sheets

U.S. PATENT DOCUMENTS

| | | | | |
|---|---|---|---|---|
| 6,783,465 | B2 | 8/2004 | Matsunaga | |
| 6,783,466 | B2 | 8/2004 | Seki et al. | |
| 6,830,519 | B2 * | 12/2004 | Reed et al. | 473/290 |
| 6,945,876 | B2 | 9/2005 | Nakahara et al. | |
| 7,303,488 | B2 | 12/2007 | Kakiuchi et al. | |
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2003/0236133 | A1 | 12/2003 | Shimazaki et al. | |
| 2004/0078955 | A1 * | 4/2004 | Matsunaga | 29/527.5 |
| 2004/0204264 | A1 | 10/2004 | Matsunaga et al. | |
| 2005/0003904 | A1 | 1/2005 | Imamoto et al. | |
| 2005/0023329 | A1 | 2/2005 | Song | |
| 2005/0124436 | A1 * | 6/2005 | Kakiuchi et al. | 473/345 |
| 2006/0063608 | A1 * | 3/2006 | Mori et al. | 473/345 |

FOREIGN PATENT DOCUMENTS

| | | | | |
|---|---|---|---|---|
| JP | 6-510689 | A | | 12/1994 |
| JP | 07-155410 | A | | 6/1995 |
| JP | 7-284546 | A | | 10/1995 |
| JP | 8-164229 | A | | 6/1996 |
| JP | 10263120 | | | 10/1998 |
| JP | 11-057085 | A | | 3/1999 |
| JP | 2000-317018 | A | | 11/2000 |
| JP | 2001-346918 | A | | 12/2001 |
| JP | 2002315855 | | | 10/2002 |
| JP | 2003-52866 | A | | 2/2003 |
| JP | 2003-79768 | A | | 3/2003 |
| JP | 2003-88601 | A | | 3/2003 |
| JP | 2004-65660 | A | | 3/2004 |
| JP | 2004-167127 | A | | 6/2004 |
| JP | 2004-180759 | A | | 7/2004 |
| JP | 2004-222792 | A | | 8/2004 |
| JP | 2004-229820 | A | | 8/2004 |
| JP | 2005-006698 | A | | 1/2005 |
| JP | 2005-130935 | A | | 5/2005 |
| JP | 2005-137788 | A | | 6/2005 |
| JP | 2005-168665 | A | | 6/2005 |
| JP | 2005137788 | A | * | 6/2005 |
| WO | WO 99/22824 | A1 | | 5/1999 |

* cited by examiner

HOLLOW GOLF CLUB HEAD

FIELD OF THE INVENTION

The present invention relates to a hollow golf club head in which the launch angle of a ball is increased so that the traveling distance of a shot can be increased.

BACKGROUND OF THE INVENTION

In recent years, hollow golf club heads have been proposed in which not only their face portion but also their crown portion deform elastically when hitting a ball, to increase the launch angle, so as to increase the traveling distance of a shot.

Japanese Patent Laid-Open No. 2003-52866 discloses a hollow golf club head made of metal and having a face portion, sole portion, side portion, crown portion, and hosel portion. This golf club head is formed of a front part and back part. The front part is made of a cast product in which at least the main portion of the crown portion and the face portion are integrally formed. In the back part, portions other than the front part are integrally formed. The front and back parts are joined to each other.

Japanese Patent Laid-Open No. 2003-79768 discloses a hollow golf club head made of metal and having at least a face portion, sole portion, side portion, and crown portion. A metal material that forms the crown portion has the lowest modulus of longitudinal elasticity.

Japanese Patent Laid-Open No. 2003-88601 discloses a hollow golf club head made of metal and having a face portion, sole portion, toe-side side portion, heel-side side portion, back-side side portion, crown portion, and hosel portion. The crown portion has a plurality of grooves extending from the toe-side side portion to the heel-side side portion.

Japanese Patent Laid-Open No. 2005-137788 discloses a hollow golf club head having a face portion with a face surface to hit the ball, and a head main body portion continuous to the rear surface of the face portion and extending to the back of the head. The head main body portion includes a crown portion, sole portion, and side portion which respectively form a head upper portion, head bottom portion, and head side portion. The crown portion includes a crown front portion and crown rear portion. The crown front portion forms a front region extending from the rear surface of the face portion to a position at a distance 0.15 times a crown depth length Lc. The crown rear portion forms a rear region extending from the rear surface of the face portion to a position at a distance 0.30 times to 1.0 time the crown depth length Lc. The crown front portion has a rigidity lower than that of the crown rear portion.

The conventional golf club heads described above still have room for improvement in terms of increasing the launch angle of a ball.

SUMMARY OF THE INVENTION

The present invention has been made in order to overcome the deficits of prior art.

According to the aspects of the present invention, it is provided a hollow golf club head having a sole portion and a crown portion, wherein a ratio of a rigidity of the sole portion to that of the crown portion is 1:0.1 to 0.8.

The hollow golf club head according to the aspects of the invention can increase the launch angle of a ball so that the traveling distance of a shot can be further increased.

According to the aspects of the present invention, the rigidity refers to a value calculated by the following equation (x):

$$\text{rigidity (unit: MPa·mm}^4\text{)} = E \times I \quad \text{(x)}$$

where

E: Young's modulus (unit: MPa)

I: moment of inertia of area (unit: $mm^4$)

Young's modulus E depends on the material constituting the golf club head, and the moment I of inertia of area depends on the thickness of the constituent of the golf club head. If the thickness of is the same, the ratio of rigidity is determined by the ratio of magnitudes of Young's modulus E. If the material is the same, the ratio of rigidity is determined by the value of the cube of the ratio of the thicknesses.

According to the aspects of the present invention, the sole portion of the golf club head refers to a portion extending backward from the lower portion of a face portion of the golf club head to form the bottom portion of the head. The crown portion of the golf club head refers to a portion extending backward from the upper portion of the face portion to form the upper portion of the head. A side portion of the golf club head refers to a portion extending backward from between the upper and lower portions of the face portion to form a head side portion. The side portion includes a toe-side side portion, heel-side side portion, and back-side side portion.

According to the aspects of the present invention, preferable value of the ratio of the rigidity of the sole portion to that of the crown portion is 1:0.2 to 0.6.

According to the aspects of the present invention, in order to increase the launch angle of a ball, the ratio of the rigidity of the sole portion to that of the side portion is preferably 1:0.1 to 0.8. A more preferable value of the ratio of the rigidity of the sole portion to that of the side portion is 1:0.2 to 0.6.

According to the aspects of the present invention, the ratio of the average thickness of the sole portion to that of the crown portion is preferably 1:0.3 to 0.8. A more preferable value of the ratio of the average thickness of the sole portion to that of the crown portion is 1:0.5 to 0.7.

According to the aspects of the present invention, preferably, the average thickness of the sole portion is 0.9 mm to 2.0 mm, the average thickness of the crown portion is 0.5 mm to 1.2 mm.

According to the aspects of the present invention, the ratio of Young's modulus of the material of the sole portion to that of the material of the crown portion is preferably 1:0.3 to 0.9. A more preferable value of the ratio of Young's modulus of the material of the sole portion to that of the material of the crown portion is 1:0.5 to 0.8.

In the present invention, preferably, Young's modulus (E) of the material of the sole portion is 105,000 MPa to 120,000 MPa, and Young's modulus of the material of the crown portion is 70,000 MPa to 95,000 MPa.

The manufacturing method for the golf club head according to the aspects of the present invention is not particularly limited. For example, the golf club head can be manufactured by closing a face opening of a head main body with a face member. In this case, the material and molding method for the head main body are not particularly limited. Titanium, a titanium alloy, stainless steel, an amorphous material, or the like can be used as the material. The head main body can be monolithically molded by casting. The material and molding method for the face member are also not particularly limited. As with the material, titanium, a titanium alloy, stainless steel, an amorphous material, or the like can be used. As the molding method, forging, press forming of pressing a plate material, or die casting is preferable.

The method for joining the face member to the head main body is not particularly limited, but plasma welding, laser welding, or electron beam welding is suitable in terms of finishing the joined portion with a good appearance and improving the weight accuracy of the golf club head. In this case, plasma welding can be employed in which a welding target material is dissolved by a high-temperature energy generated by plasma arc and solidified again to weld. As for laser welding, known laser welding which uses a gas laser such as CO laser or $CO_2$ laser, or a solid laser such as a YAG laser can be employed. As for electron beam welding, known electron beam welding which uses an electron beam having an appropriate output can be employed.

The golf club head according to the aspects of the present invention can be formed as, e.g., a wood type golf club head or utility type golf club head having a hollow portion. More specifically, the golf club head according to the aspects of the present invention can be formed as a hollow golf club head having the following head volume and loft angle:

(a) a hollow golf club head having a head volume of 250 $cm^3$ to 470 $cm^3$ and a loft angle in a range from 7 to 15 degrees, (b) a hollow golf club head having a head volume of 150 $cm^3$ to 250 $cm^3$ and a loft angle in a range from 12 to 28 degrees, and (c) a hollow golf club head having a head volume of 70 $cm^3$ to 150 $cm^3$ and a loft angle in a range from 15 to 32 degrees.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
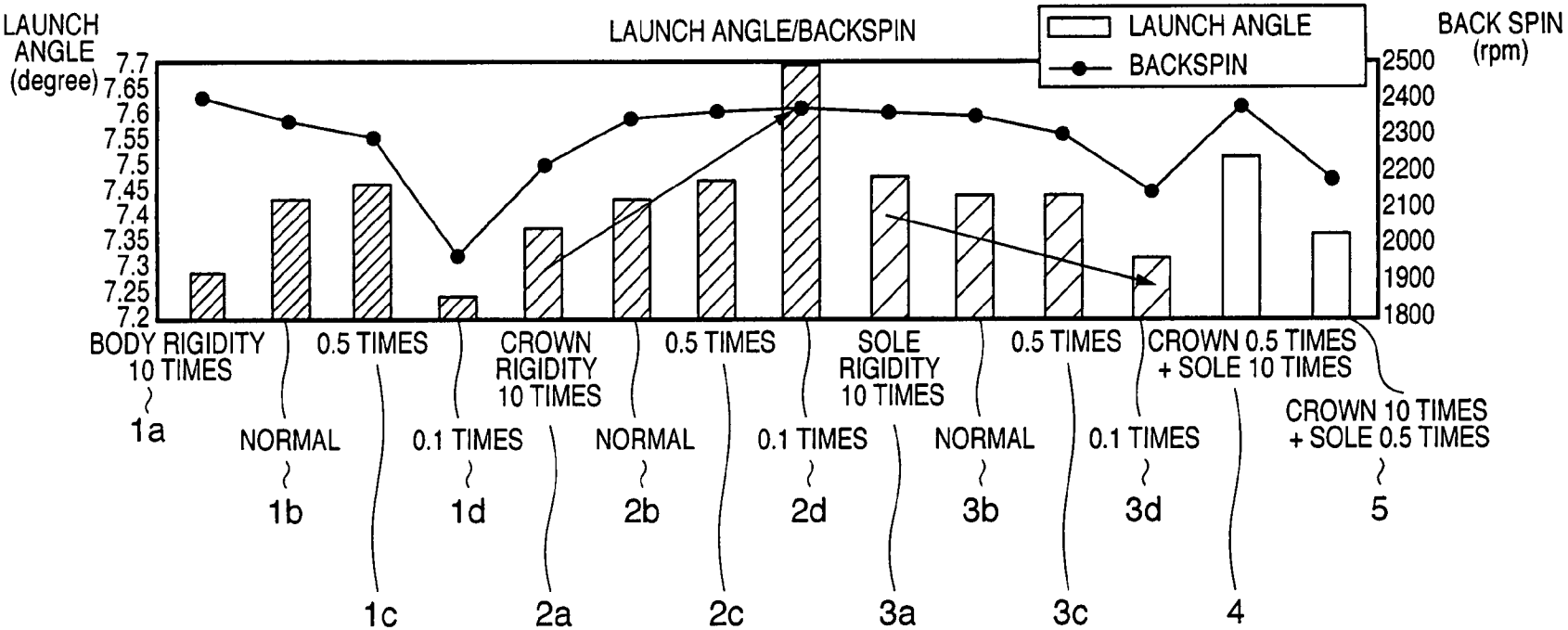
FIG. 1 is a graph showing variations of the launch angle of a ball and the backspin amount when body rigidity, crown rigidity, and sole rigidity of a golf club head are changed.

First, an experiment that demonstrates the effect of the present invention will be described. FIG. 1 is a graph showing variations of the launch angle of a ball angle and the backspin amount when the rigidity of the entire golf club head (body rigidity), the rigidity of the crown portion (crown rigidity), and the rigidity of the sole portion (sole rigidity) are changed. Referring to FIG. 1, sample number 1*a* indicates a golf club head with body rigidity 10 times the normal value. Sample number 1*b* indicates a golf club head with normal body rigidity (1 time). Sample number 1*c* indicates a golf club head with body rigidity 0.5 times the normal value. Sample number 1*d* indicates a golf club head with body rigidity 0.1 times the normal value. Sample number 2*a* indicates a golf club head with crown rigidity 10 times the normal value. Sample number 2*b* indicates a golf club head with normal crown rigidity (1 time). Sample number 2*c* indicates a golf club head with crown rigidity 0.5 times the normal value. Sample number 2*d* indicates a golf club head with crown rigidity 0.1 times the normal value. Sample number 3*a* indicates a golf club head with sole rigidity 10 times the normal value. Sample number 3*b* indicates a golf club head with normal sole rigidity (1 time). Sample number 3*c* indicates a golf club head with sole rigidity 0.5 times the normal value. Sample number 3*d* indicates a golf club head with sole rigidity 0.1 times the normal value. Sample number 4 indicates a golf club head with crown rigidity 0.5 times the normal value and sole rigidity 10 times the normal value. Sample number 5 indicates a golf club head with crown rigidity 10 times the normal value and sole rigidity 0.5 times the normal value. The results of FIG. 1 show that when the rigidity of the crown portion is decreased and that of the sole portion is increased, the launch angle of a ball increases.

Figure 2:
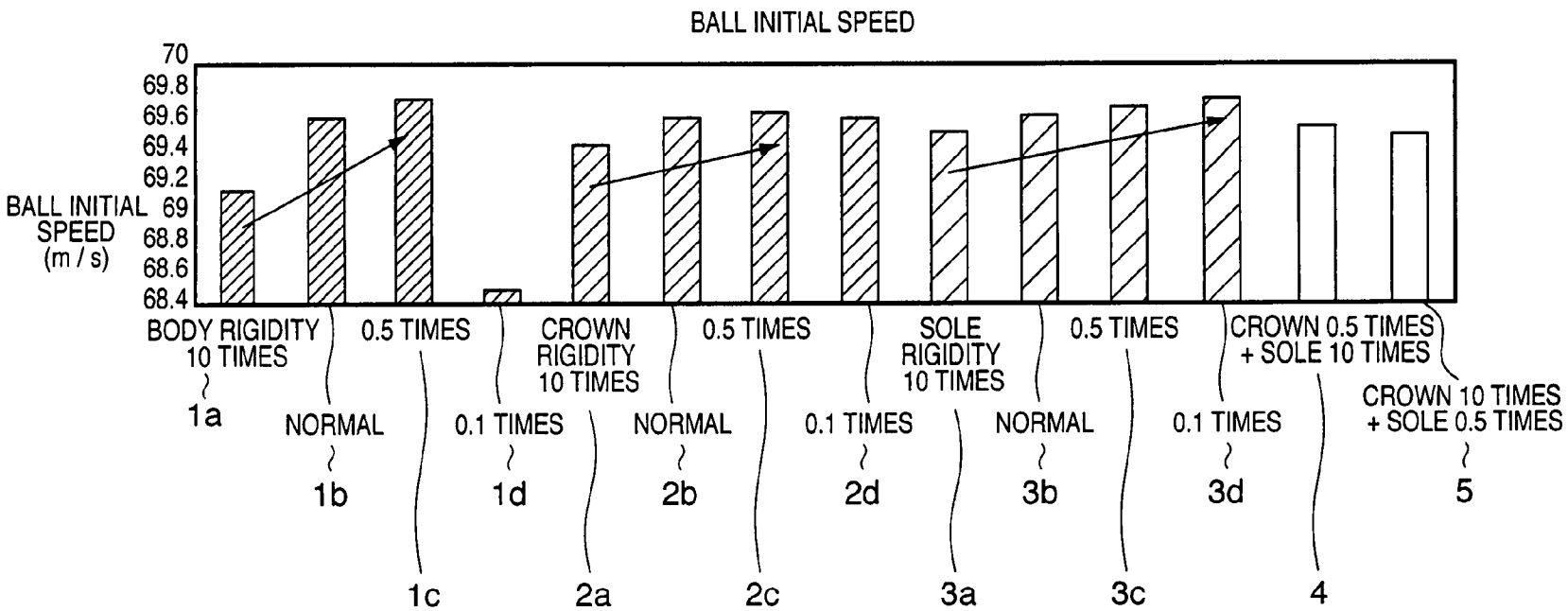
FIG. 2 is a graph showing variations of the initial speed of a ball when the body rigidity, crown rigidity, and sole rigidity of the golf club head are changed.

FIG. 2 is a graph showing variations of the initial speed of a ball when body rigidity, crown rigidity, and sole rigidity are changed. FIG. 2 is used as a comparison with the present invention in which the launch angle of a ball is increased. Referring to FIG. 2, sample numbers 1*a* to 1*d*, 2*a* to 2*d*, 3*a* to 3*d*, 4, and 5 indicate the same golf club heads as those of FIG. 1. The results of FIG. 2 show that when the rigidities of both the crown portion and sole portion are decreased, the initial speed of a ball increases.

Figure 3:
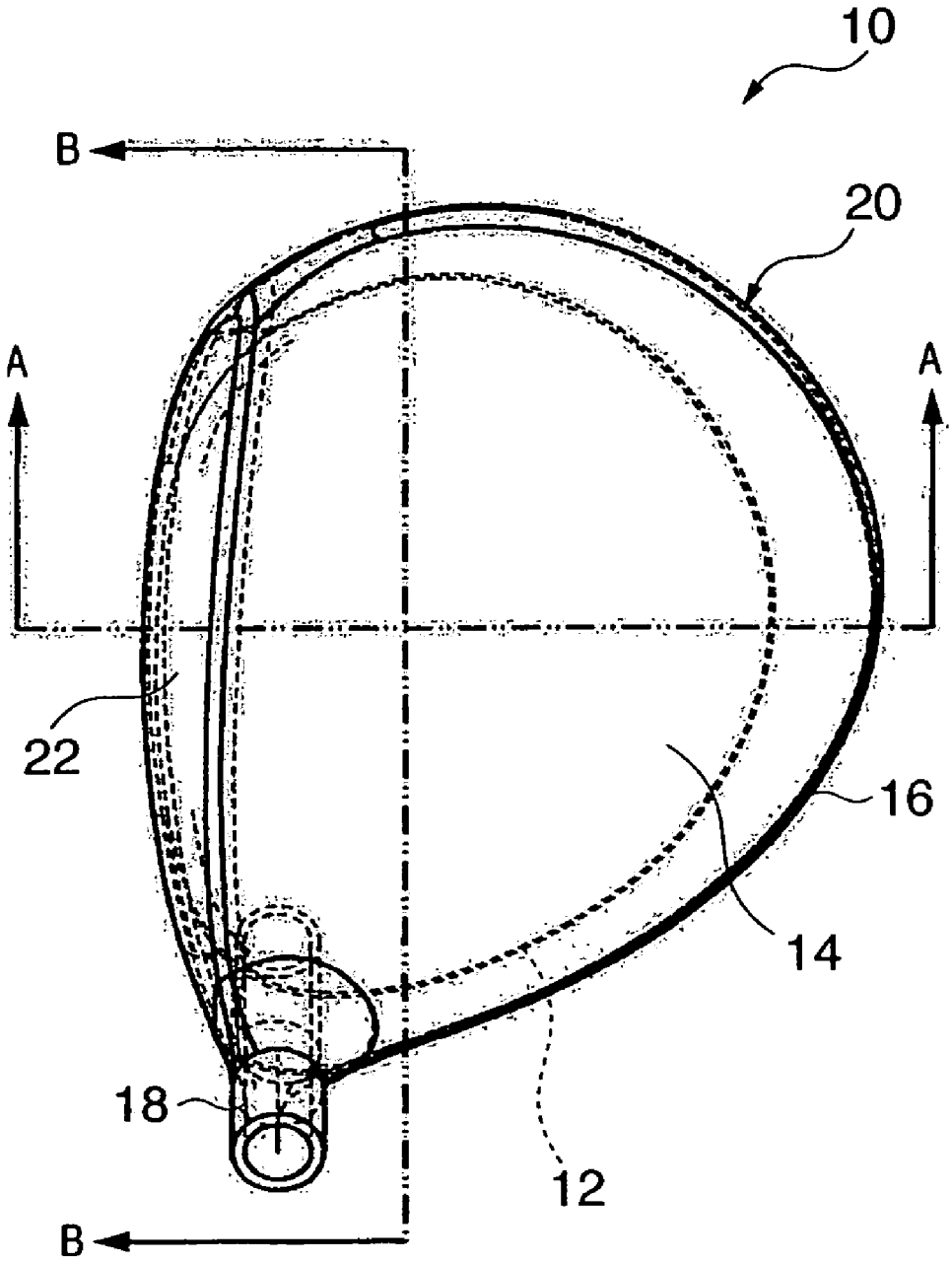
FIG. 3 is a plan view showing a golf club head according to an embodiment of the present invention.
Figure 4:
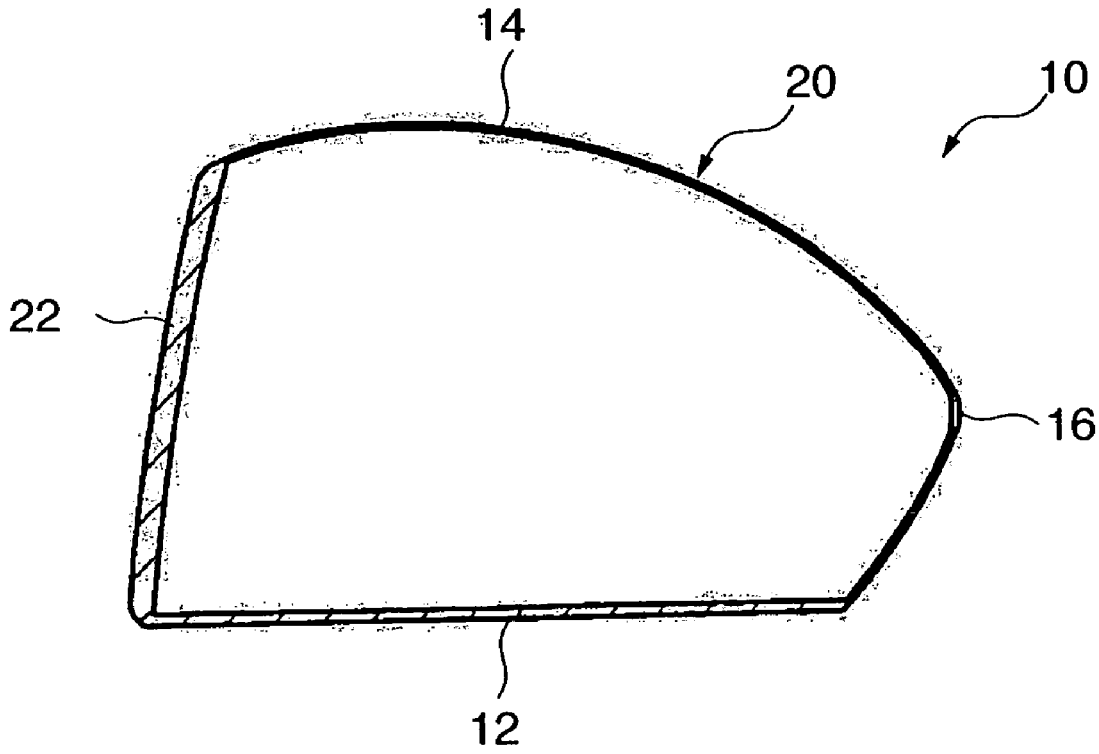
FIG. 4 is a sectional view taken along the line A-A of FIG. 3.
Figure 5:
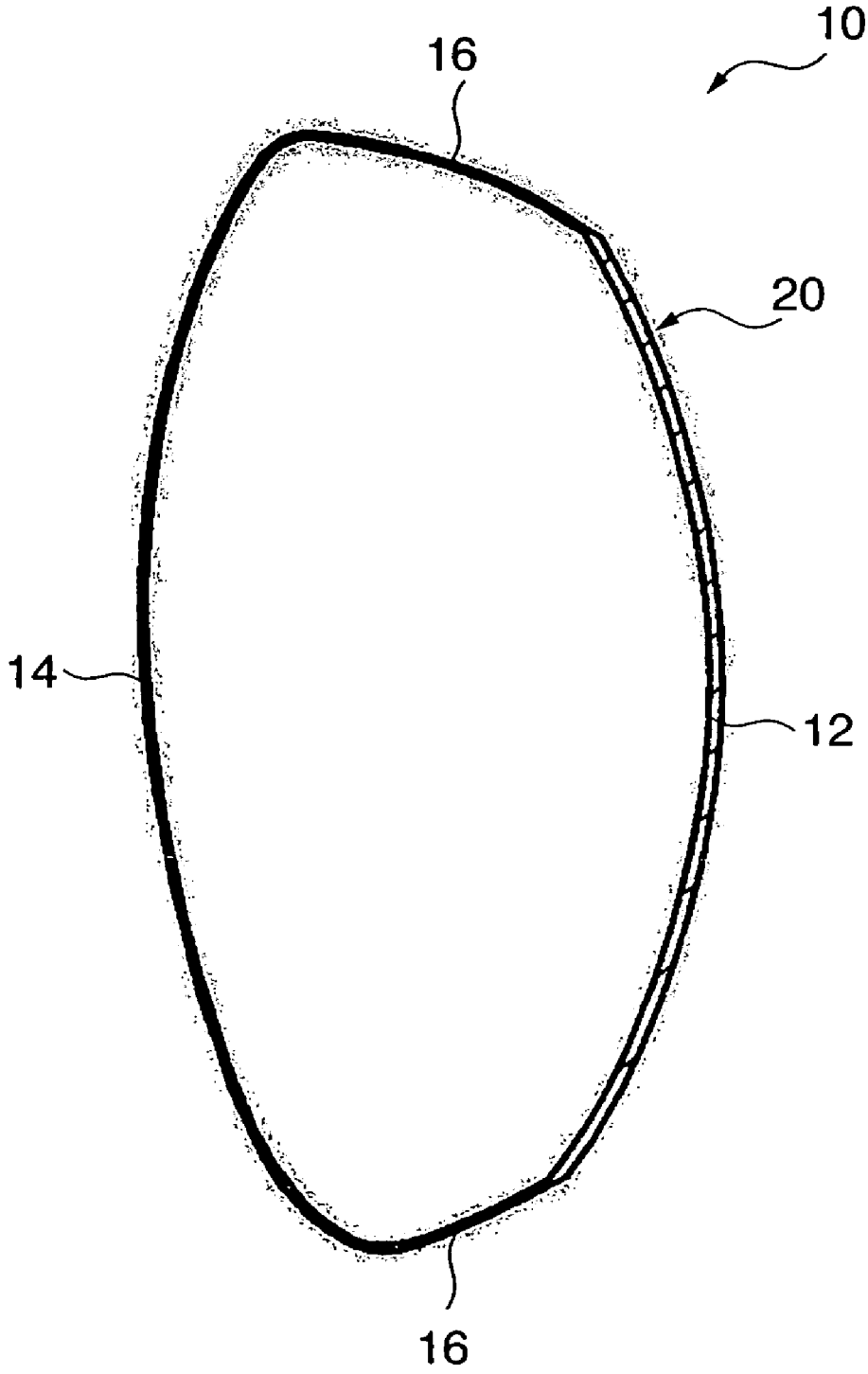
FIG. 5 is a sectional view taken along the line B-B of FIG. 3.

FIG. 3 is a plan view showing a golf club head according to an embodiment of the present invention, FIG. 4 is a sectional view taken along the line A-A of FIG. 3, and FIG. 5 is a sectional view taken along the line B-B of FIG. 3.

A golf club head 10 according to this embodiment is obtained by fixing a face member 22 to the face opening of a head main body 20 having a sole portion 12, crown portion 14, side portion 16, and hosel portion 18 by plasma welding. The material of the head main body 20 is 6-4Ti (Ti-6Al-4V) and the material of the face member 22 is SP700 (Ti-4. 5Al-3V-2Fe-2Mo). The golf club head of this embodiment is formed as a No. 1 wood golf club head having a head volume of 400 $cm^3$.

In the golf club head 10 of this embodiment, the ratio of the rigidity of the sole portion 12 to that of the crown portion 14 is 1:0.4, and the rigidity of the sole portion 12 to that of the side portion 16 is 1:0.4

In the golf club head 10 according to this embodiment, the thicknesses of the sole portion 12, crown portion 14, side portion 16, and face member 22 are uniform, which are 1.3 mm, 0.6 mm, 0.6 mm, and 3 mm, respectively. Hence, the ratio of the average thickness of the sole portion 12 to that of the crown portion 14 is 1:0.46.

Figure 6:
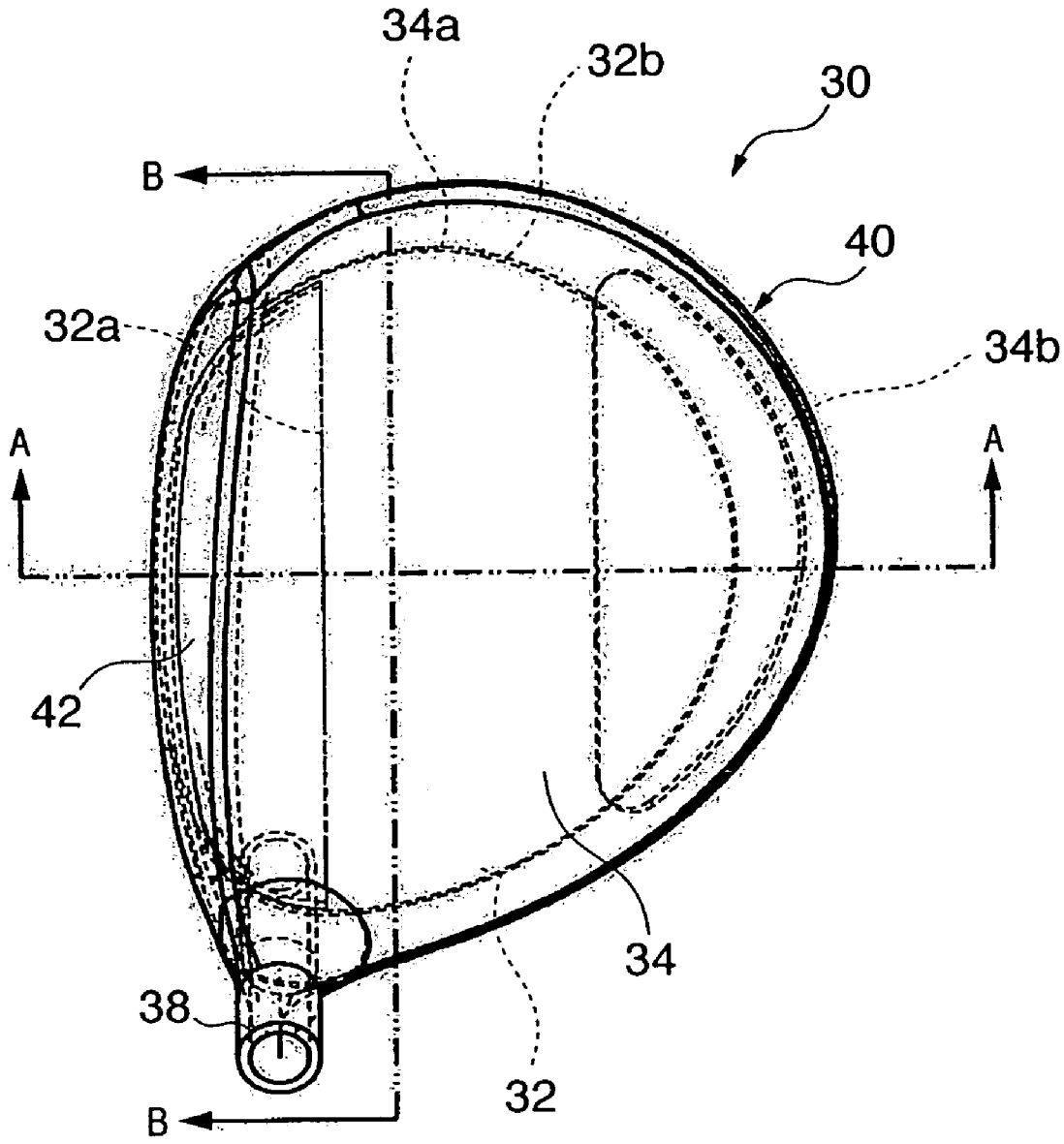
FIG. 6 is a plan view showing a golf club head according to another embodiment of the present invention.
Figure 7:
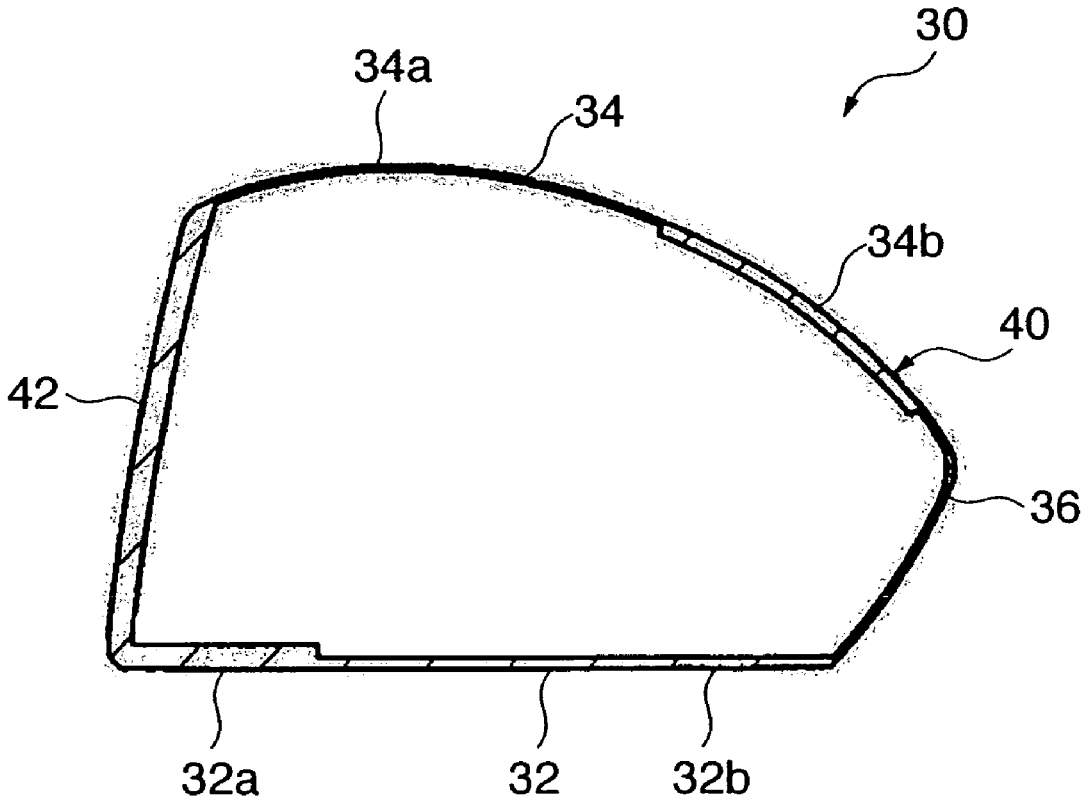
FIG. 7 is a sectional view taken along the line A-A of FIG. 6.
Figure 8:
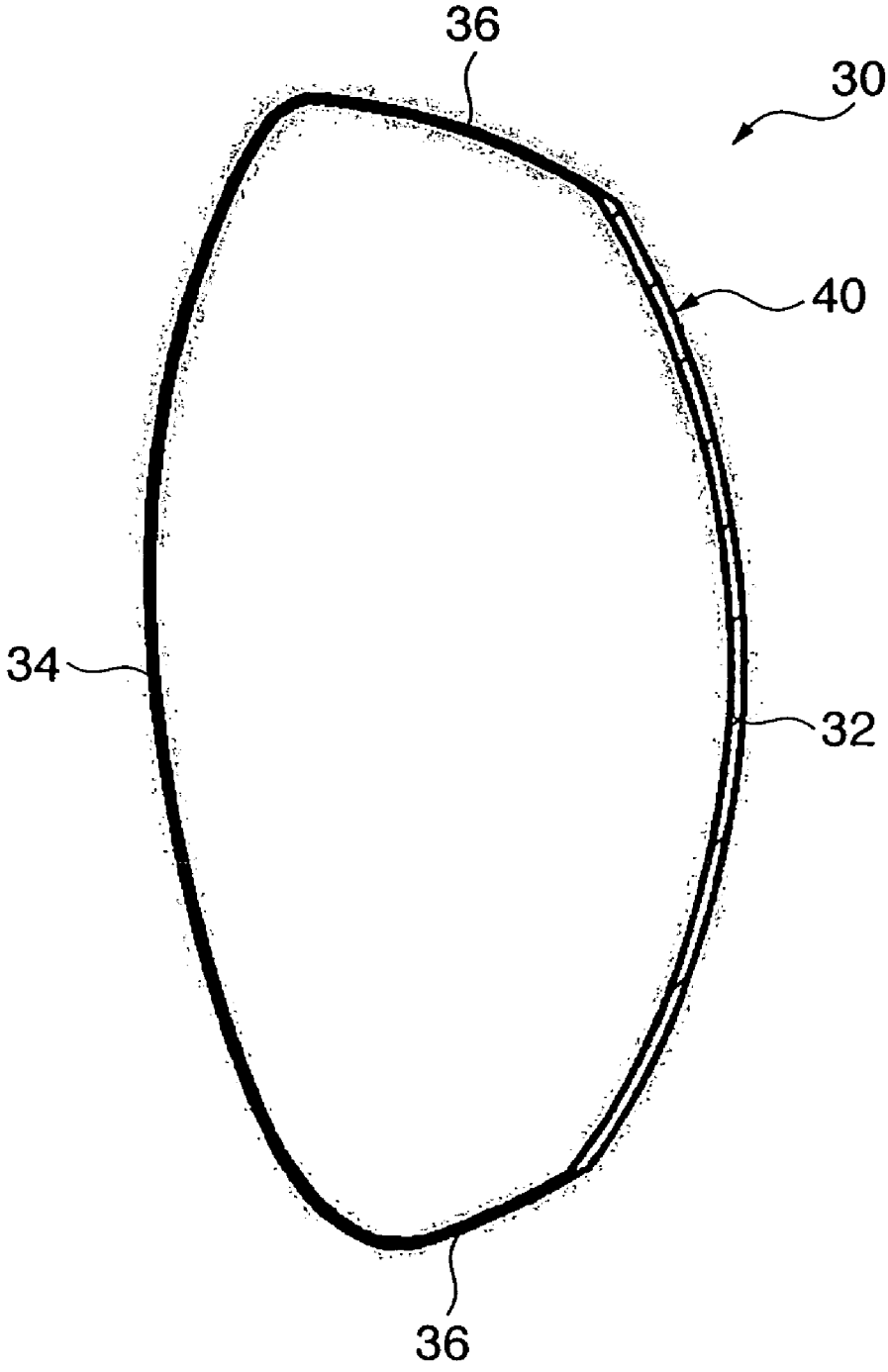
FIG. 8 is a sectional view taken along the line B-B of FIG. 6.

FIG. 6 is a plan view showing a golf club head according to another embodiment of the present invention, FIG. 7 is a sectional view of the golf club head taken along the line A-A of FIG. 6, and FIG. 8 is a sectional view of the golf club head taken along the line B-B of FIG. 6.

A golf club head 30 according to this embodiment is obtained by fixing a face member 42 to the face opening of a head main body 40 having a sole portion 32, crown portion 34, side portion 36, and hosel portion 38 by plasma welding. The material of the head main body 40 is 6-4Ti (Ti-6Al-4V) and the material of the face member 42 is SP700 (Ti-4. 5Al-3V-2Fe-2Mo). The golf club head of this embodiment is formed as a No. 1 wood golf club head having a head volume of 400 $cm^3$.

In the golf club head 30 according to this embodiment, the ratio of the rigidity of the sole portion 32 to that of the crown portion 34 is 1:0.3, and the ratio of the rigidity of the sole portion 32 to that of the side portion 36 is 1:0.2.

In the golf club head 30 according to this embodiment, a sole thick-walled region 32*a* having a thickness of 2.5 mm is formed on the face side of the sole portion 32, and a sole thin-walled region 32*b* having a thickness of 1.2 mm is formed on the back side of the sole portion 32. A crown thin-walled region 34*a* having a thickness of 0.6 mm is formed on the face side of the crown portion 34, and a crown thick-walled region 34*b* having a thickness of 1.5 mm is formed on the back side of the crown portion 34. The average thickness of the sole portion 32 is 1.7 mm, and that of the crown portion 34 is 0.9 mm. Hence, the ratio of the average thickness of the sole portion 32 to that of the crown portion 34 is 1:0.53. The thicknesses of the side portion 36 and face member 42 are uniform, which are 0.6 mm and 3 mm, respectively.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2005-241747 filed on Aug. 23, 2005, the entire contents of which are hereby incorporated by reference herein.

What is claimed is:

1. A hollow golf club head comprising:
a face portion;
a side portion;
a sole portion; and
a crown portion,
wherein said crown portion includes a thin-walled region formed on a face side of said crown portion and a thick-walled region formed on a back side of said crown portion,
said thin-walled-region begins from an upper end of said face portion,
said sole portion includes a thin-walled region formed on a back side of said sole portion and a thick-walled region formed on a face side of said sole portion,
a thickness of said side portion is the same as a thickness of said thin-walled region in said crown portion,
said thick-walled region of said sole portion is formed from a heel-side end of said sole portion to a toe-side end of said sole portion and has a uniform thickness, and
said thick-walled region in said crown portion and said thick-walled region in said sole portion do not overlap with each other when viewed in a direction perpendicular to a surface of the sole portion.

2. The golf club head according to claim 1, wherein said sole portion and said
crown portion are configured such that a ratio of an average thickness of said sole
portion to an average thickness of said crown portion is 1:0.3 to 0.8.

3. The golf club head according to claim 1, wherein the golf club head is configured to have a head volume in a range from 250 $cm^3$ to 470 $cm^3$, and
wherein the golf club head is configured to have a loft angle in a range from 7 to 15 degrees.

4. The golf club head according to claim 1, wherein the golf club head is configured to have a head volume in a range from 150 $cm^3$ to 250 $cm^3$, and
wherein the golf club head is configured to have a loft angle in a range from 12 to 28 degrees.

5. The golf club head according to claim 1, wherein the golf club head is configured to have a head volume in a range from 70 $cm^3$ to 150 $cm^3$, and
wherein the golf club head is configured to have a loft angle in a range from 15 to 32 degrees.

6. The golf club head according to claim 1, wherein said sole portion and said crown portion are configured such that an average thickness of said crown portion is thinner than an average thickness of said sole portion.

7. The golf club head according to claim 1, wherein said thick-walled region in said crown portion has a semicircular shape.

8. The golf club head according to claim 1, wherein said thin-walled region of said crown portion is formed from a heel-side end of said crown portion to a toe-side end of said crown portion.

9. A hollow golf club head comprising:
a face portion;
a side portion;
a sole portion; and
a crown portion,
wherein said crown portion includes a thin-walled region formed on a face side of said crown portion and a thick-walled region formed on a back side of said crown portion,
said sole portion includes a thin-walled region formed on a back side of said sole portion and a thick-walled region formed on a face side of said sole portion, and
said thick-walled region in said crown portion and said thick-walled region in said sole portion do not overlap with each other when viewed in a direction perpendicular to a surface of the sole portion.

* * * * *